US007554489B2

(12) United States Patent
Tsai et al.

(10) Patent No.: US 7,554,489 B2
(45) Date of Patent: Jun. 30, 2009

(54) INCLINED ANTENNA

(75) Inventors: Feng-Chi Eddie Tsai, Taipei Hsien (TW); Chih-Ming Wang, Taipei Hsien (TW)

(73) Assignee: Wistron Neweb Corp., Taipei Hsien (TW)

( * ) Notice: Subject to any disclaimer, the term of this patent is extended or adjusted under 35 U.S.C. 154(b) by 157 days.

(21) Appl. No.: 11/593,071

(22) Filed: Nov. 6, 2006

(65) Prior Publication Data

US 2007/0222682 A1 Sep. 27, 2007

(30) Foreign Application Priority Data

Mar. 24, 2006 (TW) ..... 95204999 U

(51) Int. Cl.
*H01Q 1/24* (2006.01)

(52) U.S. Cl. ..... 343/700 MS; 343/912

(58) Field of Classification Search ..... 343/700 MS, 343/754, 755, 911 R, 912
See application file for complete search history.

(56) References Cited

U.S. PATENT DOCUMENTS

| | | | | |
|---|---|---|---|---|
| 5,543,814 | A * | 8/1996 | Jenness, Jr. | 343/840 |
| 6,940,470 | B2 * | 9/2005 | Nesic et al. | 343/895 |
| 2006/0262027 | A1 * | 11/2006 | Zhang | 343/813 |

FOREIGN PATENT DOCUMENTS

JP 2002325016 * 11/2002

* cited by examiner

*Primary Examiner*—Tho G Phan
(74) *Attorney, Agent, or Firm*—Bacon & Thomas, PLLC

(57) ABSTRACT

The present invention provides an antenna, which includes a substrate, at least one radiating element and at least one reflecting element. The at least one radiating element is placed on the substrate at an inclined angle, and the at least one reflecting element is also placed on the substrate. The signals reflected by the at least one reflecting element substantially form an omni-directional radiation pattern through aggregation of overlapping patterns.

19 Claims, 5 Drawing Sheets

INCLINED ANTENNA

BACKGROUND OF THE INVENTION

1. Field of Invention

The present invention relates to an antenna, and more particularly, to a type of inclined antenna concealed within a hull, which is able to form an omni-directional radiation pattern.

2. Description of the Related Art

Generally speaking, an antenna of the prior art technology exposes a radiating element outside a hull; and the radiating element often arranged in a double rod-like radiating element structure. Usually in the precedent technologies, the directions in which the radiating elements are pointing are adjustable, but their drawbacks are that the antennas require a larger installation space, the protruding radiating elements impair the overall appearance, and the radiating elements cannot form an omni-directional radiation pattern.

SUMMARY OF THE INVENTION

The main objective of the present invention is to provide a type of inclined antenna which can be used to form an omni-directional radiation pattern.

Another objective of the present invention is to provide radiating elements which operate at different frequencies, and obtain optimal signal transmission by setting up these radiating elements into different types of arrangements.

In order to achieve the aforementioned objectives, the antenna of the present invention comprises: a substrate, at least one radiating element and at least one reflecting element. Wherein at least one radiating element is placed at an inclined angle on the substrate and at least one reflecting element is also placed on the substrate. Each of the reflecting elements can reflect signals generated by each of the radiating: elements, and an omni-directional radiation pattern is then formed through aggregation of overlapping patterns.

At least one radiating element is placed around the substrate, and the radiating element can be used to transmit or receive the same or different frequencies. The radiating elements are evenly distributed on the substrate if the frequencies of the radiating elements are the same, and distributed in an alternating manner around the substrate if the frequencies of the radiating elements are different in order to obtain an omni-directional radiation pattern.

BRIEF DESCIPTION OF THE DRAWINGS

Figure 3A:
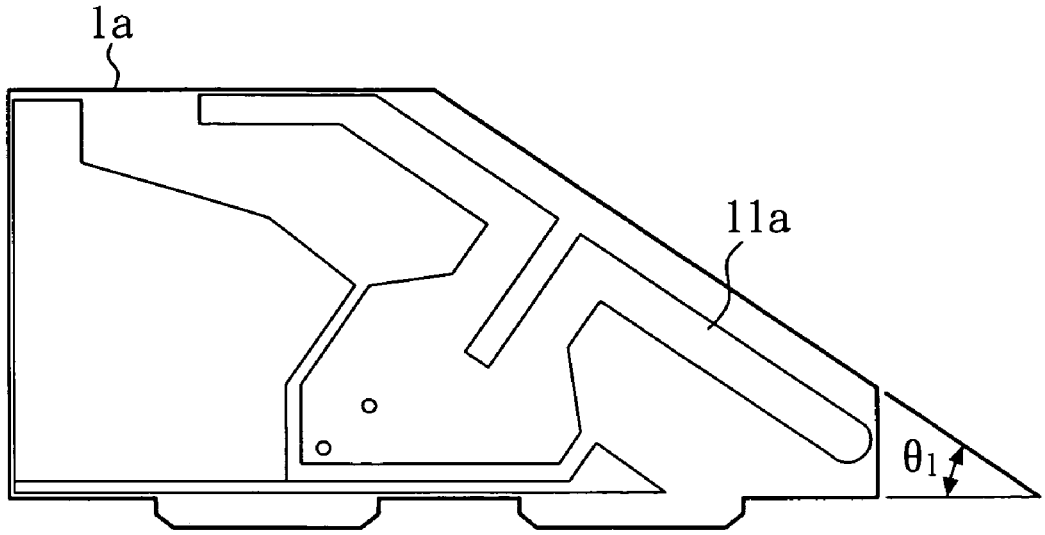

FIG. 3*a* is a side-view diagram of the first inclined antenna module in accordance with the present invention.

Figure 3B:
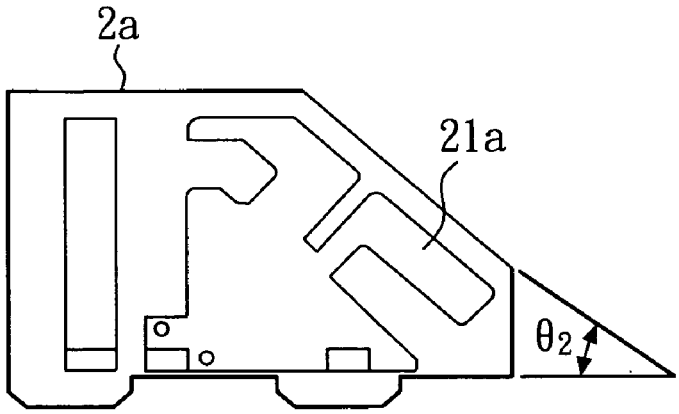

FIG. 3*b* is a side-view diagram of the second inclined antenna module in accordance with the present invention.

Figure 4:
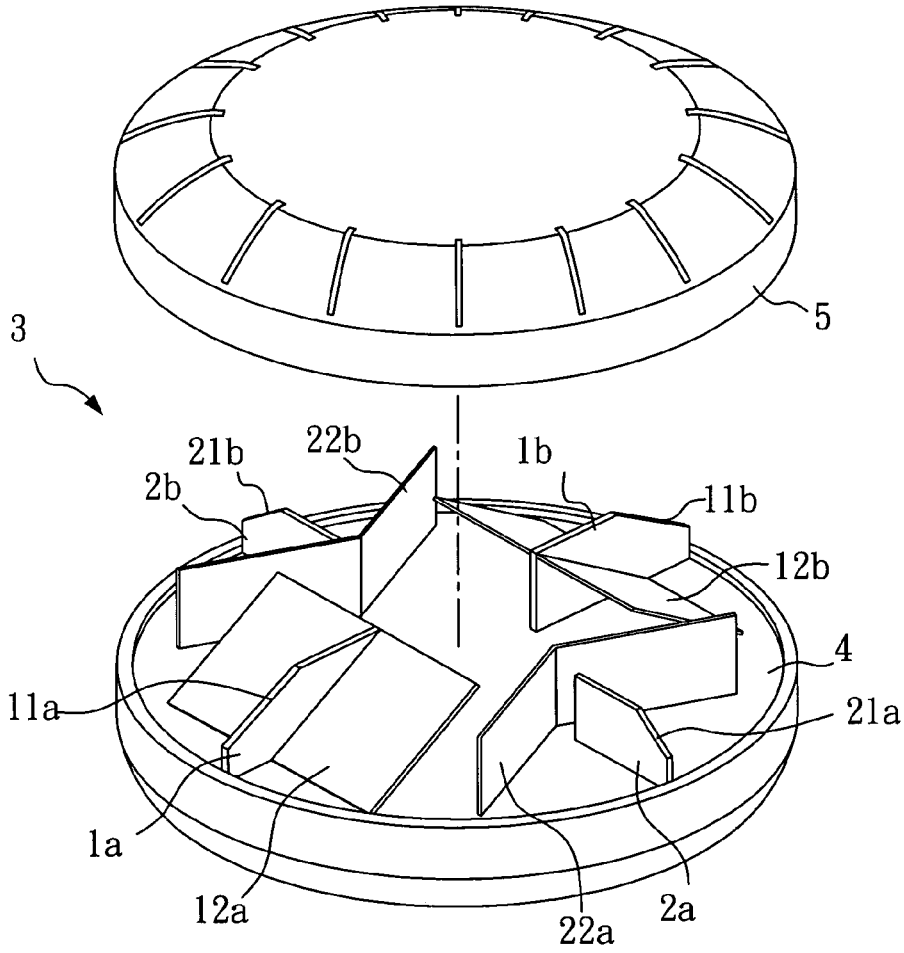

FIG. 4 is a perspective view diagram in accordance with the third preferred embodiment of the present invention.

Figure 5:
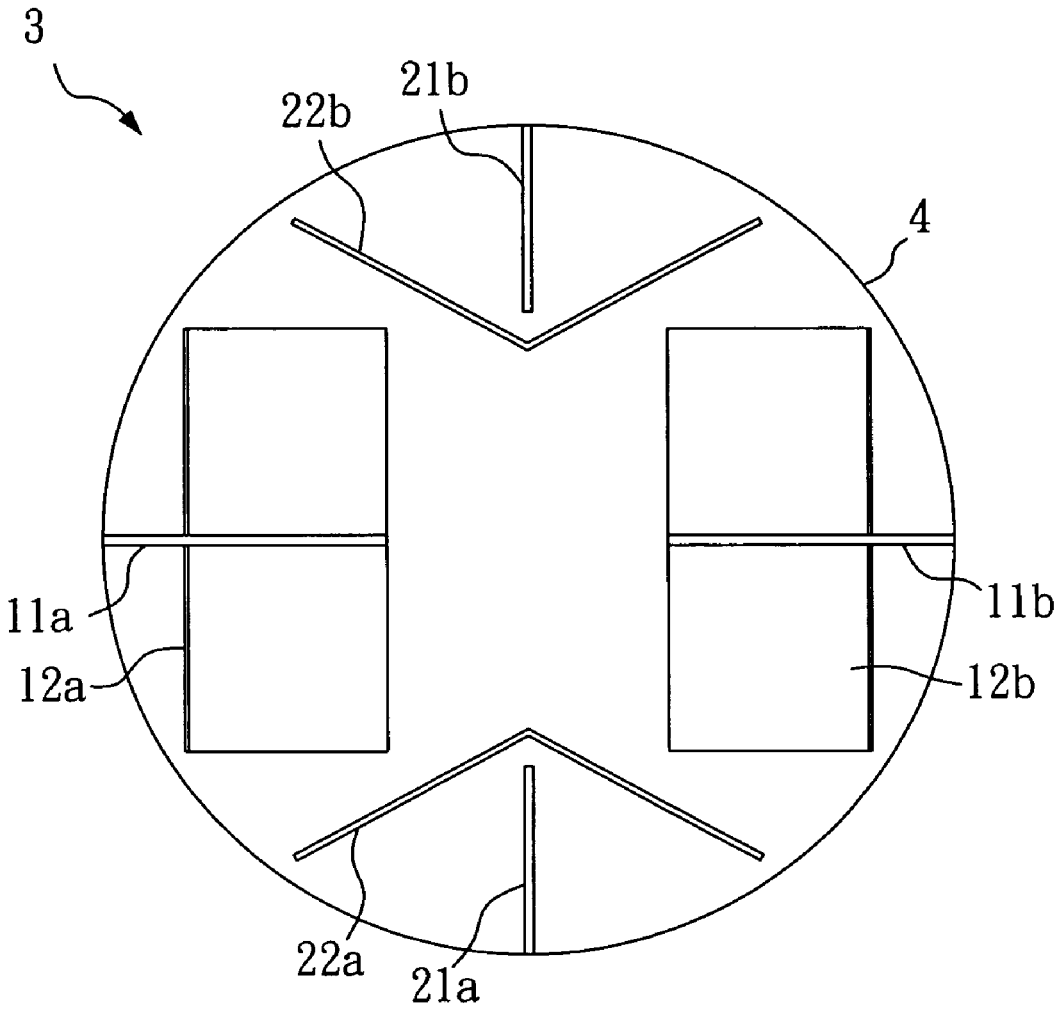

FIG. 5 is a top view diagram in accordance with the third preferred embodiment of the present invention.

Figure 6A:
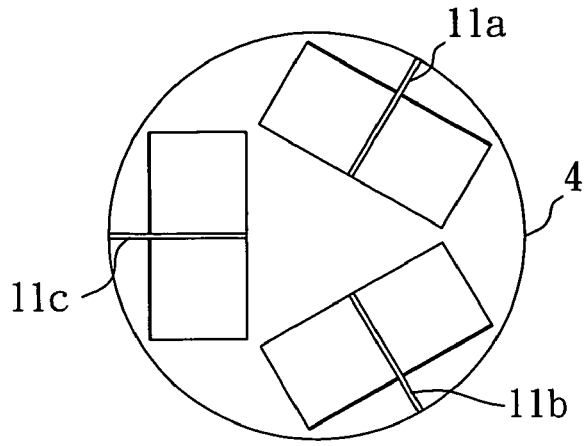
Figure 6B:
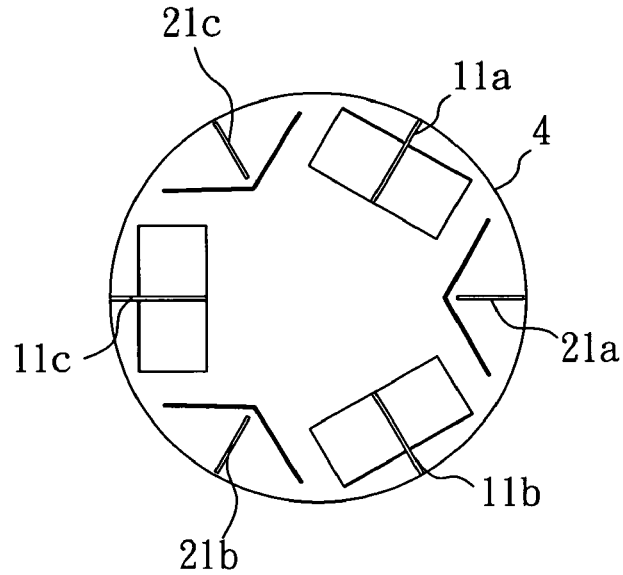
Figure 6C:
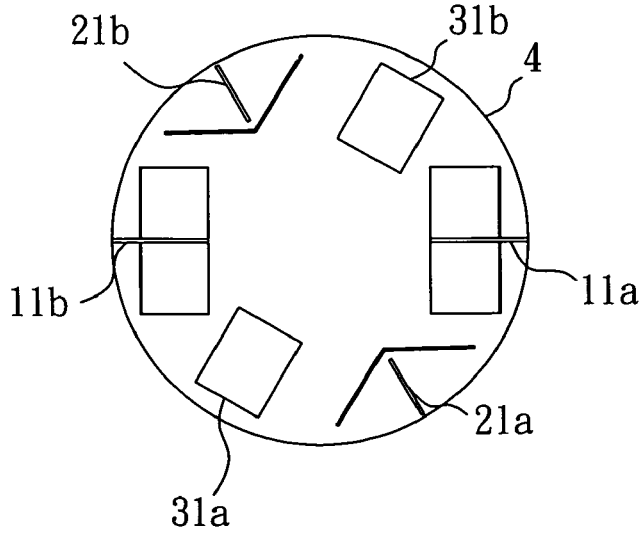

FIG. 6*a* to 6*c* are diagrams in accordance with the other preferred embodiments of the present invention.

DETAILED DESCRIPTION OF THE PREFERRED EMBODIMENT

Figure 1:
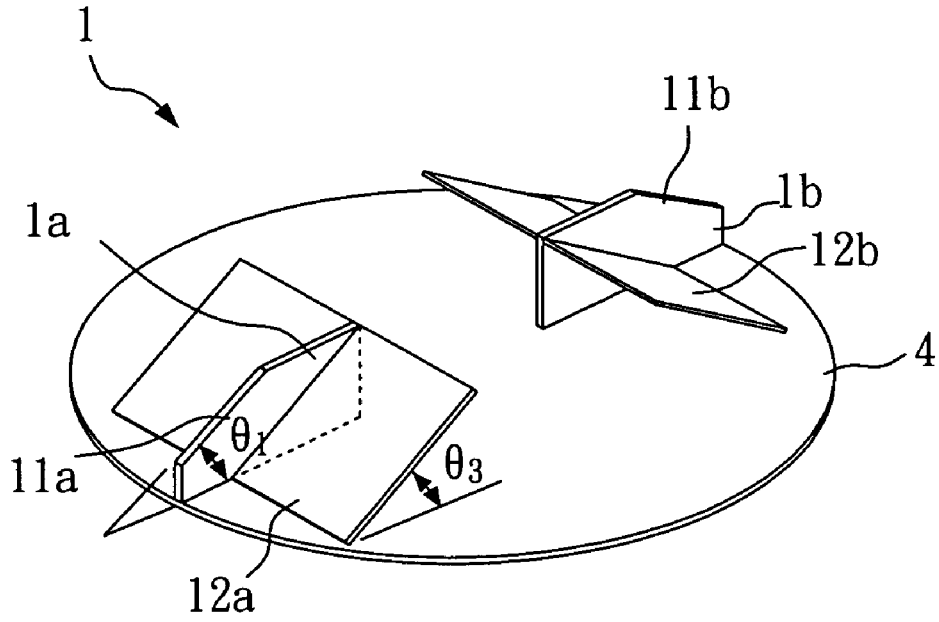
FIG. 1 is a perspective view diagram in accordance with the first preferred embodiment of the present invention.

Please refer to FIG. 1 and FIG. 3*a* which show the first preferred embodiment of the present invention. The first antenna 1 of the present invention comprises a substrate 4, first radiating elements 11*a* and 11*b*, and first reflecting elements 12*a* and 12*b*. Wherein, each of the first radiating elements 11*a* and 11*b* can either be a metallic or a circuit board. In the preferred embodiment of the present invention, the first antenna 1 possesses two first radiating elements 11*a* and 11*b*, and two first reflecting elements 12*a* and 12*b*, but the present invention is not confined to this arrangement. The present invention can also comprise of one or more than three radiating and reflecting element pairs.

The first antenna 1 further comprises first inclined antenna modules 1*a* and 1*b*. In the preferred embodiment, each of the first inclined antenna modules 1*a* and 1*b* has the same structure. However, the present invention is not confined to this practice, as each of the first inclined antenna modules 1*a* and 1*b* can have a different structure from each other.

FIG. 3*a* shows a magnified diagram of the first inclined antenna 1*a*. For the descriptions below, please refer to FIG. 3*a* and FIG. 1 simultaneously. The first inclined antenna modules 1*a* and 1*b* can comprise the first radiating elements 11*a* and 11*b* respectively. The first radiating elements 11*a* and 11*b* are located on the first inclined antenna modules 1*a* and 1*b* respectively, and the first inclined antenna modules 1*a* and 1*b* are placed on the substrate 4. Wherein, the first inclined antenna modules 1*a* and 1*b* can either be a metallic board or a printed circuit board.

The first radiating elements 11*a* and 11*b* are placed on the substrate 4 at an angle of $\theta_1$ (herein referred to as: the inclination angle of the first radiating element $\theta_1$). In order to obtain a better down-tilt radiation pattern, the inclination angle of the first radiating element $\theta_1$ should be greater than 20 degrees, and preferably between 20 to 70 degrees.

As shown in FIG. 1, the first radiating elements 11*a* and 11*b*, and the first reflecting elements 12*a* and 12*b* are all situated on the substrate 4. Wherein, the first radiating elements 11*a* and 11*b* are symmetrically installed and facing outward. The first radiating elements 11*a* and 11*b* can transmit and receive signals at a frequency of 2.4 GHz, and its wireless signal transmission standard complies with the specifications of 802.11b or 802.11g.

As shown in FIG. 1, the first reflecting elements 12*a* and 12*b* are substantially perpendicular to the first radiating elements 11*a* and 11*b*. As a result, the first reflecting elements 12*a* and 12*b* can reflect the signals generated by the first radiating elements 11*a* and 11*b*. The signal that is being reflected this way creates a better radiation pattern and the separation effect of the first reflecting elements 11*a* and 11*b* reduce signal loss. The first reflecting elements 12*a* and 12*b* are placed on the substrate 4 at an angle of $\theta_3$ (herein referred to as: the inclination angle of the first reflecting element $\theta_3$), and this angle should be greater than 20 degrees, and preferably between 20 to 70 degrees to achieve the optimal effect. In the present preferred embodiment, the inclination angle of the first reflecting element $\theta_3$ for the first reflecting elements 12*a* and 12*b* can be adjusted. For example, the inclination angle of the first reflecting element $\theta_3$ can be adjusted through the use of mechanical means or other methods such as setting up a control shaft (not shown in the figures). In the preferred embodiment, the inclination angle of the first radiating element $\theta_1$ and the inclination angle of the first reflecting element $\theta_3$ are both preferred at an angle greater than 20 degrees, but the two angles need not be the same. Moreover, the preferred size of the first reflecting elements 12*a* or 12*b* shall be designed in accordance with the available capacity where it is located.

Through the present preferred embodiment, the first radiating elements 11*a* and 11*b* is collocated with the first reflecting elements 12*a* and 12*b* respectively. A radiation pattern is formed when the first reflecting elements 12*a* and 12*b* reflect the signals generated by the first radiating elements 11*a* and 11*b*, and finally, an omni-directional radiation pattern is formed through aggregation of overlapping patterns.

Figure 2:
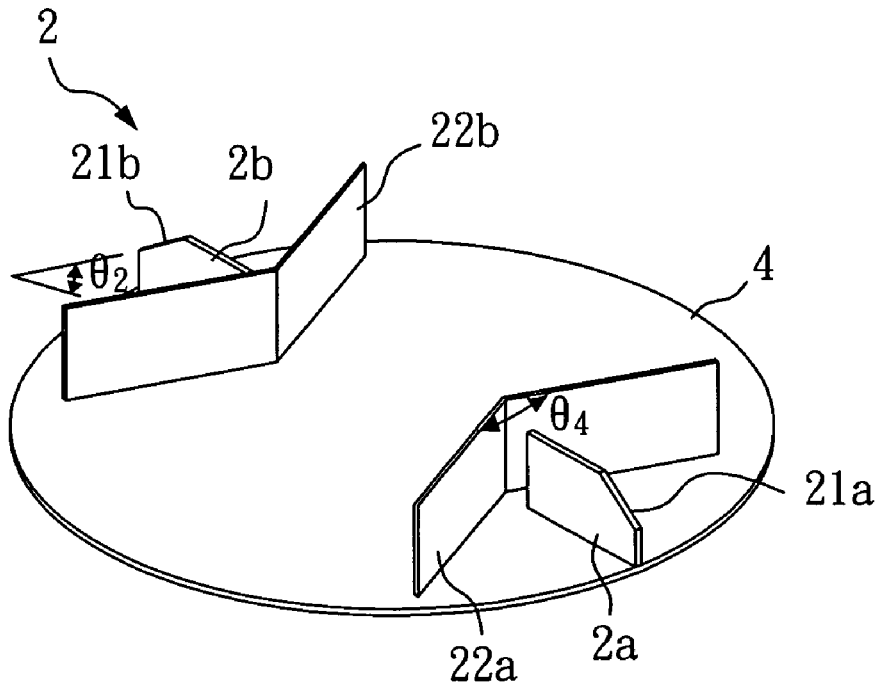
FIG. 2 is a perspective view diagram in accordance with the second preferred embodiment of the present invention.

Please refer to FIG. 2 and FIG. 3*b* for the second preferred embodiment of the present invention. The second antenna 2 of the present invention comprises a substrate 4, second radiating elements 21*a* and 21*b*, and second reflecting elements 22*a* and 22*b*. Wherein, each of the second radiating elements 21*a* and 21*b* can either be a metallic or a circuit board.

In the preferred embodiment, the second antenna 2 consists of two second radiating elements 21*a* and 21*b*, and two second reflecting elements 22*a* and 22*b*, but the present invention is not confined to this arrangement. The present invention can also comprise one or more than three radiating and reflecting element pairs.

The second antenna 2 further comprises second inclined antenna modules 2*a* and 2*b*. In the present preferred embodiment, the second inclined antenna modules 2*a* and 2*b* have the same structure; however, the present invention is not restricted to it as they need not have the same structure.

FIG. 3*b* is a magnified figure of the second inclined antenna module 2*a*. For the below descriptions, please refer to FIG. 3*b* and FIG. 2 simultaneously. The second inclined antenna modules 2*a* and 2*b* further comprise second radiating elements 21*a* and 21*b* respectively. The second radiating elements 21*a* and 21*b* are situated on the inclined antenna modules 2*a* and 2*b* respectively, and the second inclined antenna modules 2*a* and 2*b* are situated on the substrate 4. Wherein, the second inclined antenna modules 2*a* and 2*b* can either be a metallic board or a printed circuit board.

The second radiating elements 21*a* and 21*b* are placed at an angle of $\theta_2$ (herein referred to as: the inclination angle of the second radiating element $\theta_2$) on the substrate 4. In order to obtain a better radiation pattern, the inclination angle of the second radiating element $\theta_2$ should be greater than 20 degrees, and preferably between 20 to 70 degrees.

As shown in FIG. 2, the second radiating elements 21*a* and 21*b* and the second reflecting elements 22*a* and 22*b* are all situated on the substrate 4. The second radiating elements 21*a* and 21*b* exhibit symmetrical arrangement and facing outward. The second radiating elements 21*a* and 21*b* can transmit or receive signals at a frequency of 5 GHz, and its wireless signal transmission standard complies with the specifications of 802.11a.

The difference of this embodiment from the first embodiment is that the second radiating elements 21*a* and 21*b* transmit signals with a frequency of 5 GHz, and because it has shorter wavelengths, smaller reflecting elements such as the second reflecting elements 22*a* and 22*b* can be used. Furthermore, the second reflecting elements 22*a* and 22*b* can either be substantially perpendicular to the substrate 4, or they can also be placed at an inclined angle to the substrate 4. In the present embodiment, the second reflecting elements 22*a* and 22*b* are substantially perpendicular to substrate 4, and the second reflecting elements 22*a* and 22*b* are bent to form a "V" shape. The angle $\theta_4$ between the second reflecting elements 22*a* and 22 (herein referred to as: the angle between the second reflecting elements $\theta_4$) can be adjusted if required. In order to achieve the optimal effect in the preferred embodiment, the angle between the second reflecting elements $\theta_4$ should be greater than 90 degrees. Moreover, the preferred size of the second reflecting elements 22*a* or 22*b* shall be designed in accordance with the available capacity where it is located.

Through the second preferred embodiment, each of the second radiating elements 21*a* and 21*b* is collocated with each of the second reflecting elements 22*a* and 22*b* respectively. A radiation pattern is formed when the second reflecting elements 22*a* and 22*b* reflect the signals generated by the second radiating elements 21*a* and 21*b*, and finally, an omni-directional radiation pattern can be formed by aggregating the overlapping patterns.

Please note that if there is more than three second radiating elements, the angle between the second reflecting elements $\theta_4$ of the accompanying reflecting element can be smaller than 90 degrees and still achieve the objective set forth by the present invention. Moreover, the second reflecting elements 22*a* and 22*b* can be bent with a curve, and the angle of the curve can be adjusted.

Next, please refer to FIG. 4 and FIG. 5 for the third preferred embodiment of the present invention. The differences of the third preferred embodiment from the first and second preferred embodiments are that it comprises of two kinds of radiating elements that can transmit or receive signals with different frequencies, and that the radiating elements are accompanied by its corresponding reflecting elements.

As shown in FIG. 4 and FIG. 5, the third antenna 3 of the present invention comprises first radiating elements 11*a* and 11*b*, first reflecting elements 12*a* and 12*b*, second radiating elements 21*a* and 21*b*, and second reflecting elements 22*a* and 22*b*. The first radiating elements 11*a* and 11*b* are arranged in an alternating manner with the second radiating elements 21*a* and 21*b* such that different types of radiating elements are placed adjacently to each other, and these radiating elements are equally distributed around the center of the substrate 4 in order to transmit and to receive signals with different frequencies. Constructing virtual lines from the two adjacent radiating elements to the center of the substrate 4, the angle between the virtual lines is substantially 90 degrees, and the arrangement order of the four radiating elements on the substrate 4 is as follows: the first radiating element 11*a*, the second radiating element 21*a*, the first radiating element 11*b*, and the second radiating element 21*b*. Wherein, the characteristics and the relationships of both the first radiating elements 11*a* and 11*b*, and the first reflecting elements 12*a* and 12*b* have been described in the first preferred embodiment, and the characteristics and the relationships of both the second radiating elements 21*a* and 21*b*, and the second reflecting elements 22*a* and 22*b* have been described in the second preferred embodiment, therefore it will not be further elaborated.

Please note that the antenna of the present invention can be constructed through the first radiating elements 11*a* and 11*b*, and the second radiating elements 21*a* and 21*b* alone. The objective set forth by the present invention can be achieved without implementing additional first inclined antenna modules 1*a* and 1*b* or the second inclined antenna modules 2*a* and 2*b*.

Furthermore, as shown in FIG. 4, the third antenna 3 has a hull 5 which can hold the substrate 4, the first inclined antenna modules 1*a* and 1*b*, the first radiating elements 11*a* and 11*b*, the first reflecting elements 12*a* and 12*b*, the second inclined antenna modules 2*a* and 2*b*, the second radiating elements 21*a* and 21*b*, and the second reflecting elements 22*a* and 22*b*. Moreover, the radiation pattern of the third antenna 3 can be adjusted by rotating the hull 5.

Next, please refer to FIG. 6*a* to 6*c* for the different kinds of preferred embodiments of the present invention.

As shown in FIG. 6*a*, the first radiating elements 11*a*, 11*b* and 11*c* of the present invention are all equally distributed around the substrate 4. Constructing a virtual line from one radiating element to the center of the substrate 4, and then joining the line back to its adjacent radiating element will form an angle of substantially 120 degrees.

Please refer to FIG. 6*b*, the present invention can distribute the first radiating elements 11*a*, 11*b*, 11*c* and the second radiating elements 21*a*, 21*b*, 21*c* around the substrate 4 in an alternating arrangement. Wherein, different types of radiating elements are placed adjacently to each other in order to transmit or receive signals with different frequencies. For example, six radiating elements distributed on the substrate 4 can be arranged in the following clockwise order: the first radiating element 11*a*, the second radiating element 21*a*, the first radiating element 11*b*, the second radiating element 21*b*, the first radiating element 11*c*, and the second radiating element 21*c*. Constructing a virtual line from one radiating element to the center of the substrate 4, and then joining the line back to its adjacent radiating element will form an angle of substantially 60 degrees.

Please refer to FIG. 6*c*, the present invention allows the implementation for the first radiating elements 11*a* and 11*b*, and the second radiating elements 21 and 21*b*. Furthermore, it allows the implementation for the third radiating elements 31*a* and 31*b*. The third radiating elements can be implemented with the third reflecting elements (not shown in the figure). If the third reflecting elements are not implemented, the substrate will be used as the reflecting element. In the preferred embodiment, the third radiating elements 31*a* and 31*b* can transmit or receive signals that have a different frequency from the first radiating elements 11*a* and 11*b*, and from the frequency of the second radiating elements 21*a* and 21*b*. Different types of radiating elements are situated around the substrate 4 in an alternating arrangement in order to transmit or receive signals with different frequencies. For example, six radiating elements distributed on the substrate 4 can be arranged in the following clockwise order: the first radiating element 11*a*, the second radiating element 21*a*, the third radiating element 31*a*, the first radiating element 11*b*, the second radiating element 21*b*, and the third radiating element 31*b*. Constructing a virtual line from one radiating element to the center of the substrate 4, and then joining the line back to its neighboring radiating element will form an angle of substantially 60 degrees.

Please note that for the above preferred embodiment, the substrate 4 does not have to be a metallic board as it can also be a printed circuit board. The difference is that when the substrate 4 is a metallic board, each of the radiating elements needs to be connected to an electric wire in order to transmit signals to the printed circuit board below the substrate 4. Therefore, if the substrate 4 is a printed circuit board, signals can be transmitted directly through the metallic conducting strips located on the printed circuit board. Furthermore, in the preferred embodiments of the present invention, the substrate 4 has a circular shape, but the substrate 4 is not confined to this shape. As long as the substrate 4 can accommodate at least one radiating element and one reflecting element, and can be arranged in an applicable formation, then the substrate 4 can take on any shape such as a rectangle or a pentagon, and still fall within the scope of the present invention. However, the hull 5 should be designed accordingly to accommodate the shape of the substrate 4.

Moreover, to achieve a better reflecting effect, the reflecting elements of the present invention can be composed of two or more pieces of the reflecting components (not shown in the figures). Furthermore, the present invention allows single piece metallic board to be bent such that it can be used as the first reflecting element 12*a* and the first reflecting element 12*b* to correspond to the two radiating elements in achieving the objective of the present invention.

Although the present invention has been explained in relation to its preferred embodiment, it is to be understood that many other possible modifications and variations can be made without departing from the spirit and scope of the invention as hereinafter claimed.

What is claimed is:

1. An inclined antenna comprising:

a substrate;

at least one first radiating element, wherein the at least one first radiating element is positioned at an inclined angle on the substrate;

at least one first reflecting element positioned on the substrate, wherein the at least one first reflecting element reflects signals generated by the at least one first radiating element; and at least one first inclined antenna module, wherein the at least one first radiating element is positioned on the first inclined antenna module. and the first inclined antenna module comprises either a metallic board or a printed circuit board.

2. The inclined antenna as claimed in claim 1, wherein the at least one first radiating element is either a metallic or a circuit board.

3. The inclined antenna as claimed in claim 1, further comprising a hull which incorporates the at least one first radiating element, the at least one first reflecting element and the substrate], wherein the hull can be rotated to adjust a radiation pattern created by the antenna.

4. The inclined antenna as claimed in claim 1, wherein an inclination angle between the at least one first radiating element and the substrate is between 20 to 70 degrees.

5. The inclined antenna as claimed in claim 1, wherein the at least one first radiating elements are situated around the substrate.

6. An inclined antenna comprising:

a substrate, wherein the substrate is either a metallic board or a printed circuit board;

at least one first radiating element, wherein the at least one first radiating element is positioned at an inclined angle on the substrate; and at least one first reflecting element positioned on the substrate, wherein the at lest one first reflecting element reflects signals generated by the at least one first radiating element.

7. The inclined antenna as claimed in claim 6, wherein an inclination angle between the at least one first reflecting element and the substrate is 20 to 70 degrees.

8. The inclined antenna as claimed in claim 6, wherein the at least one first radiating element is substantially perpendicular to the at least one first reflecting element.

9. The inclined antenna as claimed in claim 8, wherein the at least one first radiating element can transmit or receive signals at a frequency of 2.4GHz.

10. The inclined antenna as claimed in claim 6, wherein the at least one first reflecting element is substantially perpendicular to the substrate, and the at least one first reflecting element is bent with a curve and an angle of the curve can be adjusted.

11. The inclined antenna as claimed in claim 6, wherein the at least one first reflecting element is substantially perpendicular to the substrate, and the at least one first reflecting element has a "V" shape and an angle of the "V" shape can be adjusted.

12. An inclined antenna comprising:

a substrate;

at least one first radiating element, wherein the at least one first radiating element is positioned at an inclined angle on the substrate;

at least one first reflecting element positioned on the substrate, wherein the at least one first reflecting element reflects signals generated by the at least one first radiating element;

at least one second radiating element, wherein the at least one second radiating element is positioned at an inclined angle on the substrate; and at least one second reflecting element positioned on the substrate, wherein the at least one second reflecting element reflects signals generated by the at least one second radiating element.

13. The inclined antenna as claimed in claim 12, wherein the at least one first radiating element is substantially perpendicular to the at least one first reflecting element, the at least one second reflecting element has a curved shape and is substantially perpendicular to the substrate, and a curve angle of the curved shape can be adjusted.

14. The inclined antenna as claimed in claim 13, wherein the curve angle is greater than 90 degrees.

15. The inclined antenna as claimed in claim 12, wherein the at least one first radiating element is substantially perpendicular to the at least one first reflecting element, the at least one second reflecting element has a "V" shape and is substantially perpendicular to the substrate, and an angle of the "V" shape can be adjusted.

16. The inclined antenna as claimed in claim 15, wherein the angle of the "V" shape is greater than 90 degrees.

17. The inclined antenna as claimed in claim 12, wherein the at least one second radiating element can transmit or receive signals at a frequency of 5 GHz.

18. The inclined antenna as claimed in claim 12, wherein the at least one first radiating element and the at least one second radiating element are positioned around the substrate in an alternating manner in order to transmit and receive signals with different frequencies.

19. The inclined antenna as claimed in claim 12, further comprising at least one third radiating element situated on the substrate, wherein the substrate is used to reflect signals generated by the at least one third radiating element, and at least one first, second and third radiating elements are positioned around the substrate in an alternating manner in order to transmit and receive signals with different frequencies.

* * * * *